US007008258B2

(12) United States Patent
Nakamura

(10) Patent No.: US 7,008,258 B2
(45) Date of Patent: Mar. 7, 2006

(54) CONNECTOR, A CONNECTOR ASSEMBLY AND AN ASSEMBLING METHOD

(75) Inventor: Hideto Nakamura, Yokkaichi (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 10/960,861

(22) Filed: Oct. 7, 2004

(65) Prior Publication Data

US 2005/0054233 A1 Mar. 10, 2005

(30) Foreign Application Priority Data

Sep. 10, 2003 (JP) ..... 2003-351270

(51) Int. Cl.
*H01R 3/00* (2006.01)

(52) U.S. Cl. ..... 439/489

(58) Field of Classification Search ..... 439/489, 439/352, 357, 372

See application file for complete search history.

(56) References Cited

U.S. PATENT DOCUMENTS 5,993,238 A 11/1999 Kudo et al.
6,019,629 A * 2/2000 Ito et al. ..... 439/489
6,520,786 B1 2/2003 Nakamura et al.
6,595,795 B1 7/2003 Nakamura
6,679,720 B1 1/2004 Nakamura et al.
6,685,500 B1 2/2004 Nakamura

* cited by examiner

*Primary Examiner*—Gary Paumen
*Assistant Examiner*—Phuongchi Nguyen
(74) *Attorney, Agent, or Firm*—Gerald E. Hespos; Anthony J. Casella

(57) ABSTRACT

A slider (40) is movable forward and back in a male housing (20) and is pushed back as a female housing (10) is connected with the male housing (20). A compression coil spring (S) accumulates a biasing force as the slider (40) is moved back. The male housing (20) has escaping grooves (37) for receiving locking projections (47) of the slider (40) and receiving portions (38) engageable with the locking projections (47) to prevent the slider (40) from coming out. Each locking projection (47) has a guiding surface (48*a*) for guiding the locking projection (47) over the receiving portion (38) when the slider (40) is assembled, and a restriction (49) for engaging an upper edge (37*a*) of the escaping groove (37) and restricting upward displacement of the slider (40). The restricting portions (49) bulge out more than the guiding surface (48*a*).

10 Claims, 19 Drawing Sheets

CONNECTOR, A CONNECTOR ASSEMBLY AND AN ASSEMBLING METHOD

BACKGROUND OF THE INVENTION

1. Field of the Invention

The invention relates to a connector with a partial connection preventing function.

2. Description of the Related Art

U.S. Pat. No. 6,685,400 and FIGS. 19(A) and 19(B) herein disclose a connector with a partial connection preventing function. Similar connectors are shown in U.S. Pat. No. 6,520,786, U.S. Pat. No. 6,595,797 and U.S. Pat. No. 6,679,720. With reference to FIGS. 19(A) and (B), the connector has a male housing 1 with a receptacle 1*a* and a female housing 2 that can fit in the receptacle 1*a*. A slider 3 is assembled in sliding contact with the upper surface of the female housing 2 and is slidable forward and back along the connecting direction. A compression coil spring 4 is squeezed between the slider 3 and the female housing 2. The male housing 1 pushes the slider 3 back as the housings 1, 2 are being connected. Thus, the spring 4 is compressed resiliently and accumulates a biasing force to separate the two housings 1, 2. The biasing force accumulated in the spring 4 is released to separate the housings 1, 2 if a connecting operation is interrupted prematurely. Thus, the housings 1, 2 will not be left partly connected. The female housing 2 has a restriction 5 that slides in contact with the upper surface of the slider 3 to guide sliding movements of the slider 3 and to prevent the slider 3 from being displaced upward.

The slider 3 has locking projections 6 that engage receiving portions 7 on the female housing 2, as shown in FIG. 20, to prevent the slider 3 from coming out forward from an assembled position. Slanted guiding surfaces (not shown) are formed on the rear surfaces of the locking projections 6. Thus, the locking projections 6 can easily move over the receiving portions 7 when the slider 3 is mounted into the female housing 2 from the front to provide efficient assembly. In the assembled state, the locking projections 6 escape into escaping grooves 8 formed behind the receiving portions 7.

A demand exists for reducing the height of connectors. This demand could be met by omitting the restrictions 5. In such a case, the locking projections 6 will engage the upper edges of the escaping grooves 8 to prevent the displacement of the slider 3. However, the locking projections 6 have the above-described guiding surfaces, and areas of engagement of the locking projections with the escaping grooves 8 are accordingly smaller. Thus, the displacement of the slider 3 may not be restricted sufficiently. The locking projections 6 could be enlarged to avoid this a problem. However, such an enlargement would deteriorate the assembly efficiencies.

The present invention was developed in view of the above problem and an object thereof is to improving an assembling operation.

SUMMARY OF THE INVENTION

The invention relates to a first connector with a first housing that is engageable with a second housing of a second connector. A slider is assembled to the first housing and is movable along connecting and separating directions of the housings. A biasing member is provided in the first housing and accumulates a biasing force to separate the housings as the housings are being connected. One of the slider and the first housing has at least one escaping groove for receiving a locking projection on the other of the first housing and the slider. A receiving portion engages the locking projection to prevent the slider from coming out. The locking projection has a guiding surface for guiding the locking projection over the receiving portion when the slider is assembled and has a restriction for restricting displacement of the slider along a direction intersecting a moving direction of the slider by engaging a peripheral edge of the escaping groove. The restriction bulges out more than the guiding surface.

Movement of the locking projection over the receiving portion is guided by the guiding surface as the slider is assembled into the first housing. Thus assembling efficiency is good. In the assembled state, the locking projection escapes into the escaping groove and engages the receiving portion to prevent the slider from coming out.

The second housing pushes the biasing means as the housings are being connected. Thus, the biasing means accumulates a biasing force. The biasing force accumulated in the biasing means is released to separate the housings if the connecting operation is interrupted halfway. Thus, the two housings will not be left partly connected. The slider supporting the one end of the biasing means is permitted to move when the housings are connected properly, thereby releasing the biasing force of the biasing member.

The locking projection preferably includes the restricting portion that bulges more outward than the guiding surface and that engages the peripheral edge of the escaping groove to restrict the displacement of the slider along the direction intersecting the moving direction of the slider. Thus, an area of engagement of the locking projection with the escaping groove is increased by as much as the restricting portion bulges out from the guiding surface. As a result, displacement of the slider is restricted sufficiently. Further, providing the guiding surface as before ensures a satisfactory assembling operation.

The invention also relates to a connector assembly comprising the above-described first connector and the second connector.

The slider preferably prevents disengagement of interlocking means that interlocks the two properly connected housings together.

The slider preferably is mounted on one side surface of the first housing, and the restricting portion is at a side of the locking projection opposite the mounting surface of the first housing.

The slider is likely to undergo displacement towards a side opposite the mounting surface of the first housing. However, displacement of the slider is restricted by providing the restricting portion at the side of the locking projection opposite from the mounting surface.

The slider preferably comprises one or more pushable portions that can be pushed by one or more pushing portions on the second housing as the two housings are connected. The pushable portions preferably have an overhanging surface and the pushing portions preferably have a correspondingly inclined surface.

The first housing and/or the slider may comprise a disengagement guide for guiding disengagement of the pushable portion and the pushing portion before or when the housings are connected properly.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
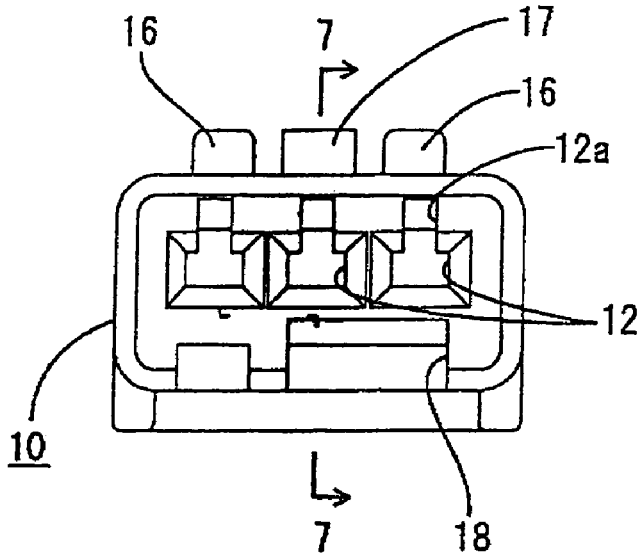
FIG. 1 is a front view of a female housing according to one embodiment of the invention.
Figure 2:
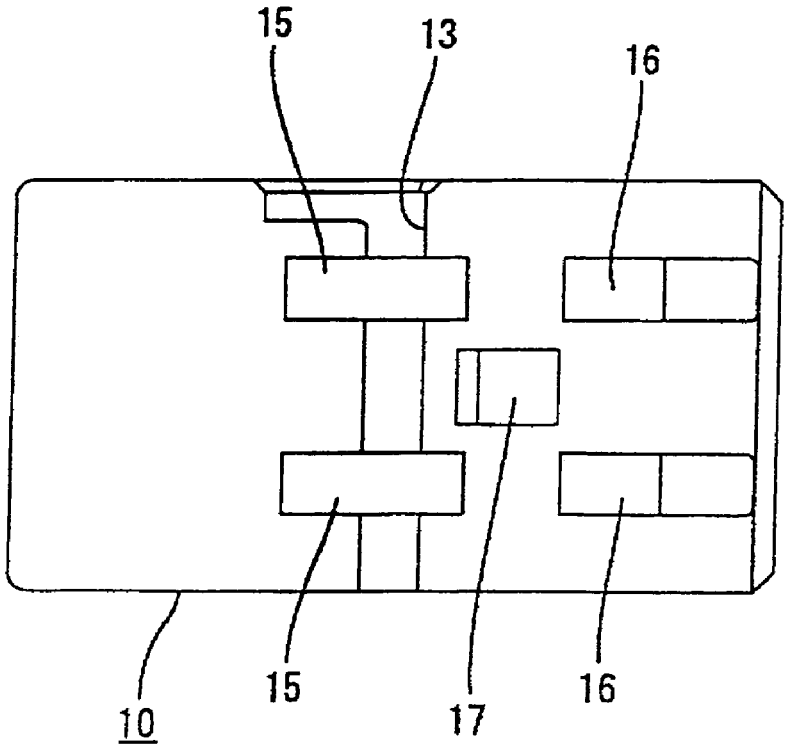
FIG. 2 is a plan view of the female housing.

A connector according to the invention is described with reference to FIGS. 1 to 18. The connector includes a female housing 10 and a male housing 20 that are connectable to one another. In the following description, engaging sides of the two housings 10, 20 are referred to as front sides, and reference is made to all the figures except FIGS. 4, 5, 10 and 11 concerning vertical direction.

The female housing 10 is made e.g. of a synthetic resin and is substantially in the form of a block. Female terminal fittings 11 are insertable from behind into each of three cavities 12 that are arranged substantially side by side along a widthwise direction in the female housing 10. Each female terminal fitting 11 has a substantially box-shaped main portion 11*a* and a barrel 11*b* that are coupled one after the other. The main portion 11*a* is electrically connectable with a male terminal fitting 25, and the barrel 11*b* is configured to be crimped, bent or folded into connection with an end of a wire W. A forwardly open locking groove 12*a* is formed in the ceiling surface of each cavity 12. The upper wall of the main portion 11*a* is cut and bent to form a cantilevered lock 11*c* for engaging the rear surface of the locking groove 12*a*. A retainer mount hole 13 is formed in an intermediate portion of side surfaces of the female housing 10 and crosses the cavities 12. A retainer 14 is movable in the retainer mount hole 13 in a direction intersecting an insertion direction of the female terminal fittings 11 into the female housing 10. The retainer 14 initially is in a first position where the female terminal fittings 11 can be inserted and withdrawn. However, the retainer 14 can be moved to a second position to engage jaws 11*d* at the rear ends of the main portions 11*a*. The retainer mount hole 13 is open in the upper surface of the female housing 10. However, the female housing 10 is reinforced by reinforcing portions 15 that bridge the front and rear edges of the retainer mount hole 13 (see FIGS. 2 and 13(A)).

Two pushing portions 16 project at positions corresponding to the reinforcing portions 15 from front on the upper surface of the female housing 10. The pushing portions 16 can push pushable portions 46 of a slider 40 of the male housing 20, and the front ends of the pushing portions 16 are receded slightly from the front end of the female housing 10. A space is defined between the pushing portions 16 and the reinforcing portions 15 for receiving the pushable portions 46. Each pushing portion 16 has a front surface 16*a* for pushing the pushable portion 46. The front surface 16*a* overhangs or is undercut and slopes up and out towards the front. Each pushing portion 16 also has a rear surface 16*b* that is a slanted up and out towards the front, as shown in FIG. 13. A lock 17 projects at an intermediate position of the upper surface of the female housing 10 between the reinforcing portions 15 and the pushing portions 16 for engaging a lock arm 31 of the male housing 20. A front surface 17*a* of the lock 17 is slanted and slopes up and out towards the back to guide a movement of the lock arm 31 onto the lock 17. A locking surface 17*b* is defined on the rear of the lock 17 and is engageable with the lock arm 31. A disengaging groove 18 is defined on the front surface of the female housing 10 below the middle and right cavities 12, as shown in FIG. 1. A forwardly and downwardly open disengaging groove 18 permits entry of resilient contacts 27*a* of a shorting terminal 27 of the male housing 20. The resilient contact pieces 27*a* can be pushed up by the peripheral edge of the disengaging groove 18.

The male housing 20 is made e.g. of a synthetic resin, and has a terminal accommodating portion 21 for accommodating the male terminal fittings 25 and the shorting terminal 27. A receptacle 22 is coupled integral or unitary to the front side of the terminal accommodating portion 21 and is configured to receive the female housing 10. A partial connection preventing unit assembly 23 is provided above and outward of the terminal accommodating portion 21 and the receptacle 22 and receives the slider 40 and the compression coil spring S, as shown in FIGS. 3 to 8 and 13, to prevent a partial connection. Bracket portion portions 24 are provided on the left surfaces of the terminal accommodating portion 21, the receptacle 22 and the assembling portion 23 for receiving brackets.

Figure 7:
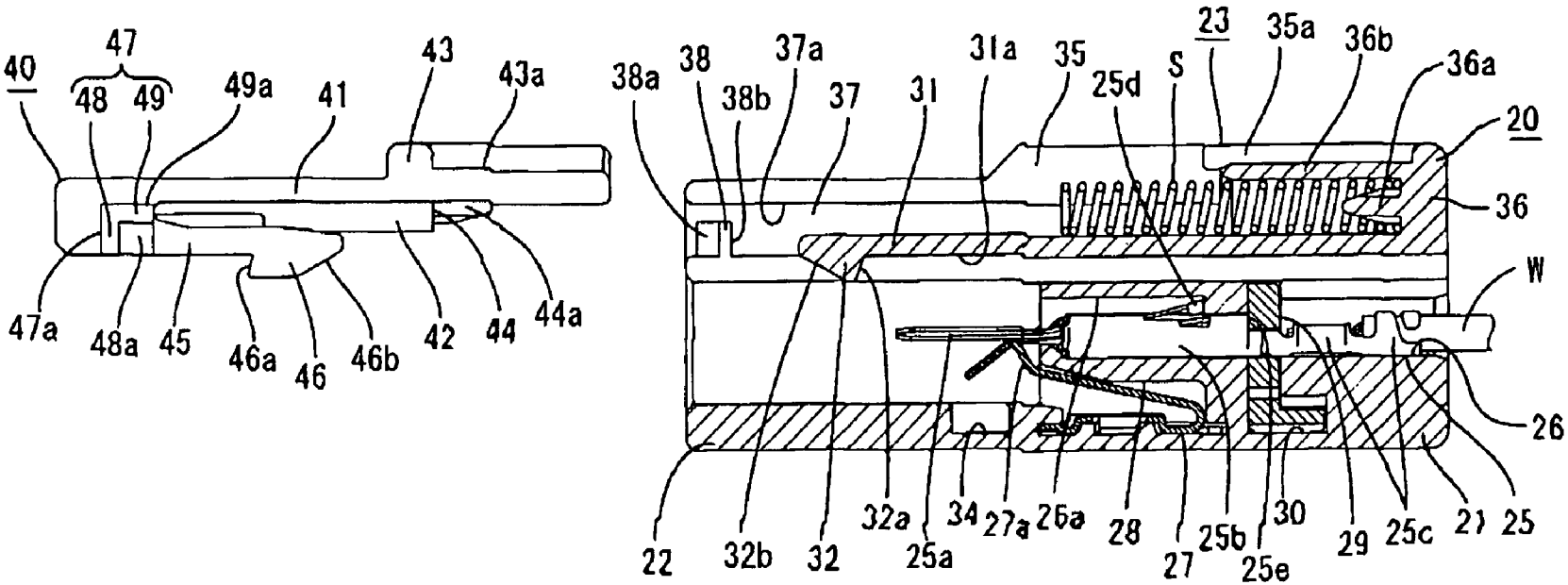
FIG. 7 is a section along 7—7 of FIG. 3 of the slider and the male housing.
Figure 8:
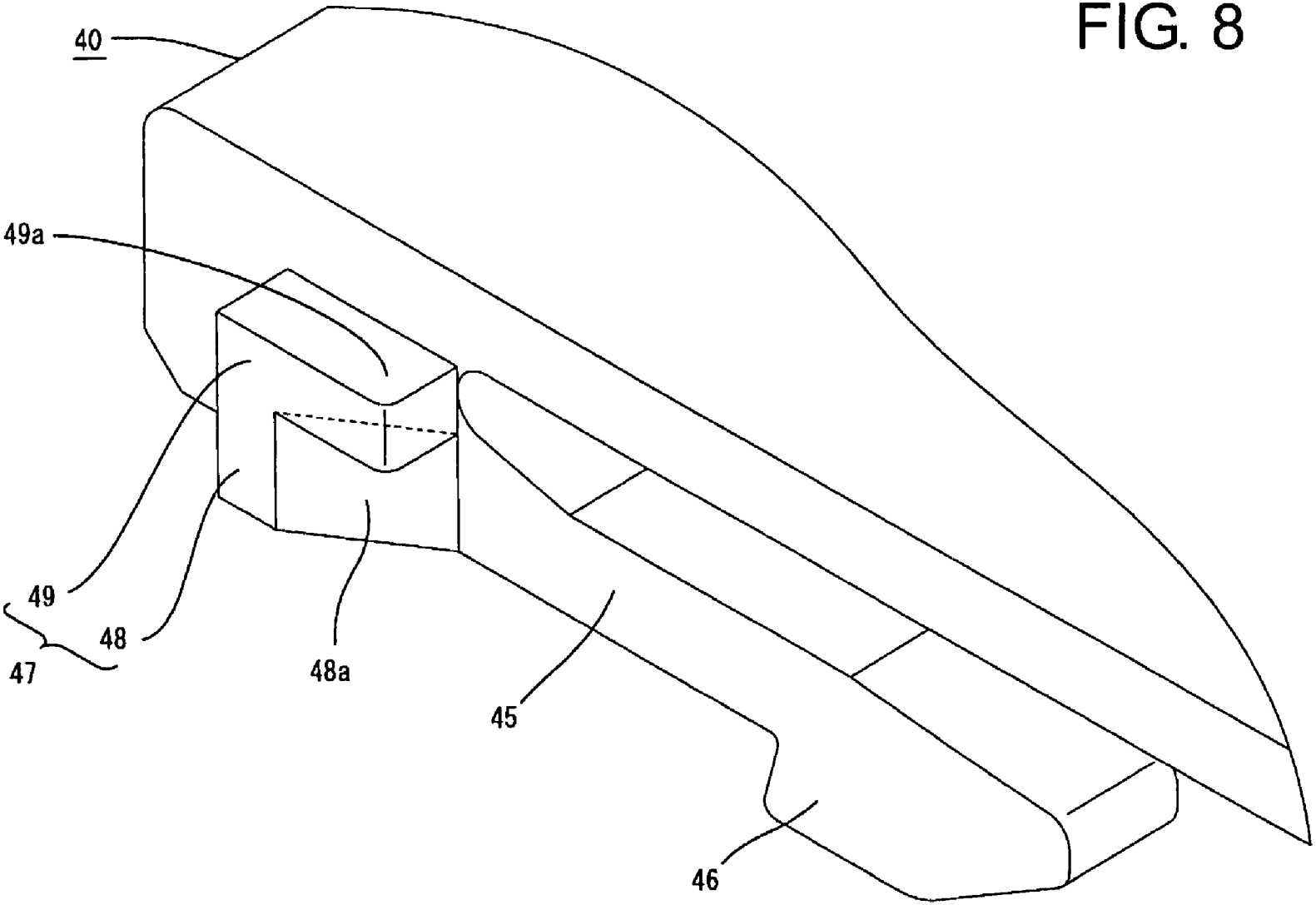
FIG. 8 is an enlarged perspective view of the slider.

Three cavities 26 are provided substantially side by side along the widthwise direction in the terminal accommodating portion 21 and are configured to receive the male terminal fittings 25 from behind, as shown in FIG. 7. Each male terminal fitting 25 has a tab 25*a*, a substantially box-shaped main portion 25*b*, and a barrel 25*c* in this order from the front. The tab 25*a* is electrically connectable with the female terminal fitting 11 and the barrel 25*c* is configured to be crimped, bent or folded into connection with an end of a wire W. A transversely open shorting-terminal accommodating chamber 28 is below the middle and left cavities 26 of FIG. 3 in the terminal accommodating portion 21 for accommodating the shorting terminal 27. The shorting terminal 27 has two resilient contact pieces 27*a* that can project into the receptacle 22 and can resiliently contact the lower surfaces of the tabs 25*a* for shorting the corresponding two male terminal fittings 25. The cavities 26 are formed with locking grooves 26*a* that engage locks 25*d* of the corresponding main portion 25*b*. The terminal accommodating portion 21 is formed with a retainer mount hole 30 for receiving a retainer 29 that locks jaws 25*e* of the main portions 25*b*. No detailed description is given on them since they take constructions similar to those of the female housing 10.

Figure 3:
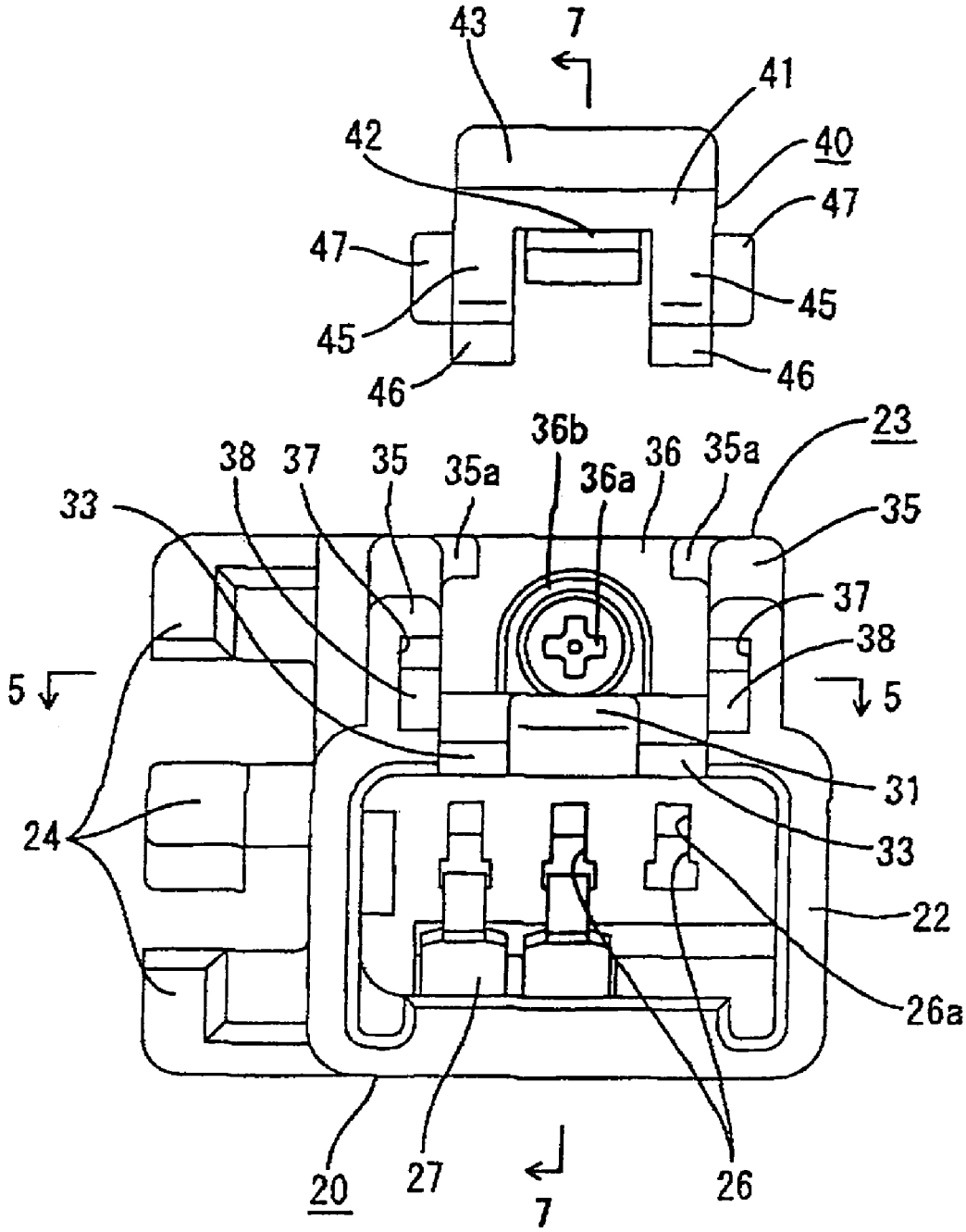
FIG. 3 is a front view of a male housing and a slider.

As shown in FIGS. 3 and 7, the receptacle 22 is a substantially rectangular tube having an open front end, and the lock arm 31 is a cantilever provided by cutting an upper part of the receptacle 22 over a specified range. The lock arm 31 is substantially in the widthwise middle of the receptacle 22, and is resiliently deformable substantially vertically about a base near the front end of the terminal accommodating portion 21. A rearwardly open groove 31*a* is formed in the lower surface of the lock arm 31 and a locking claw 32*a* is formed at the front end. A rear surface 32*a* of the locking claw 32 can engage the rear surface 17*b* of the lock 17 to hold the two housings 10, 20 connected. The rear surface 32*a* of the locking claw 32 is sloped up and out towards the back. Thus, the lock arm 31 resiliently deforms and automatically cancels the locked state if a force of a specified intensity or higher acts to separate the two housings 10, 20 locked in their connected state. In other words, the lock arm 31 and the lock 17 take a so-called semi-locking construction. The front surface 32*b* of the locking claw 32 is sloped up and out towards the front in order to guide a movement of the lock arm 31 onto the lock 17.

Figure 9:
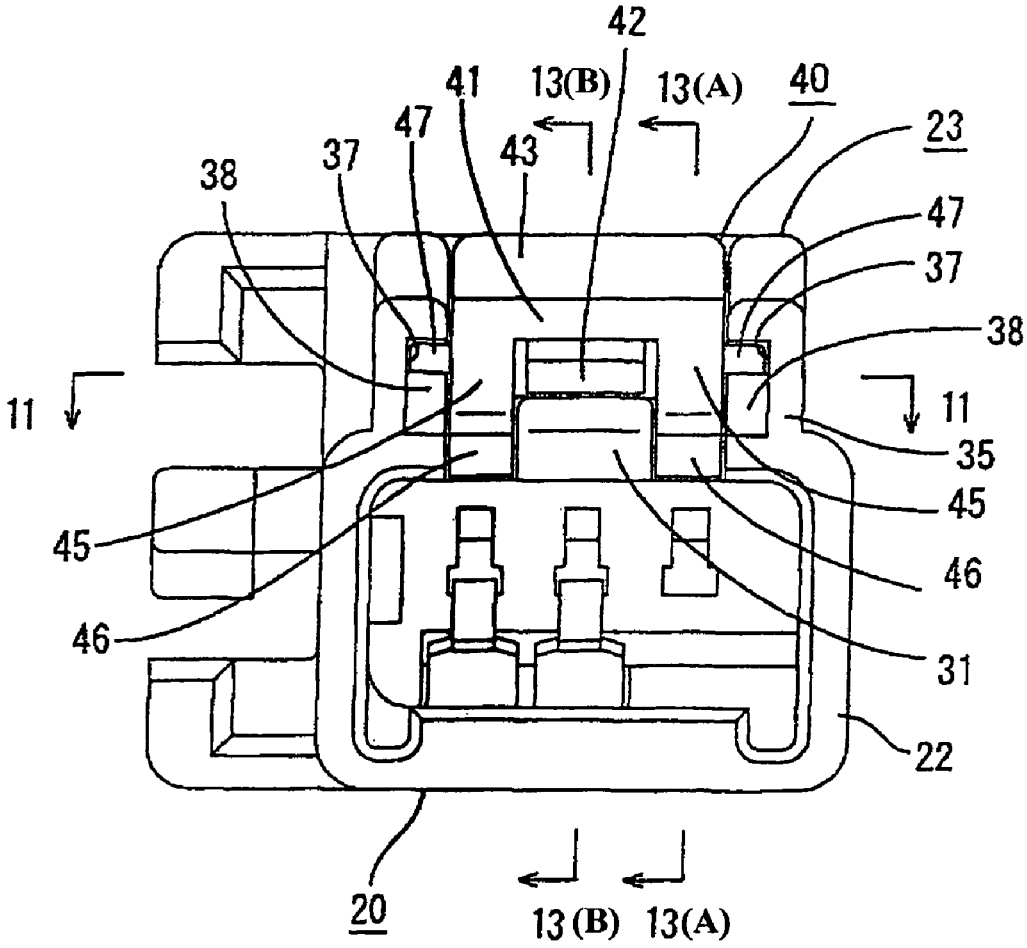
FIG. 9 is a front view of the male housing having the slider mounted at an initial position.
Figure 10:
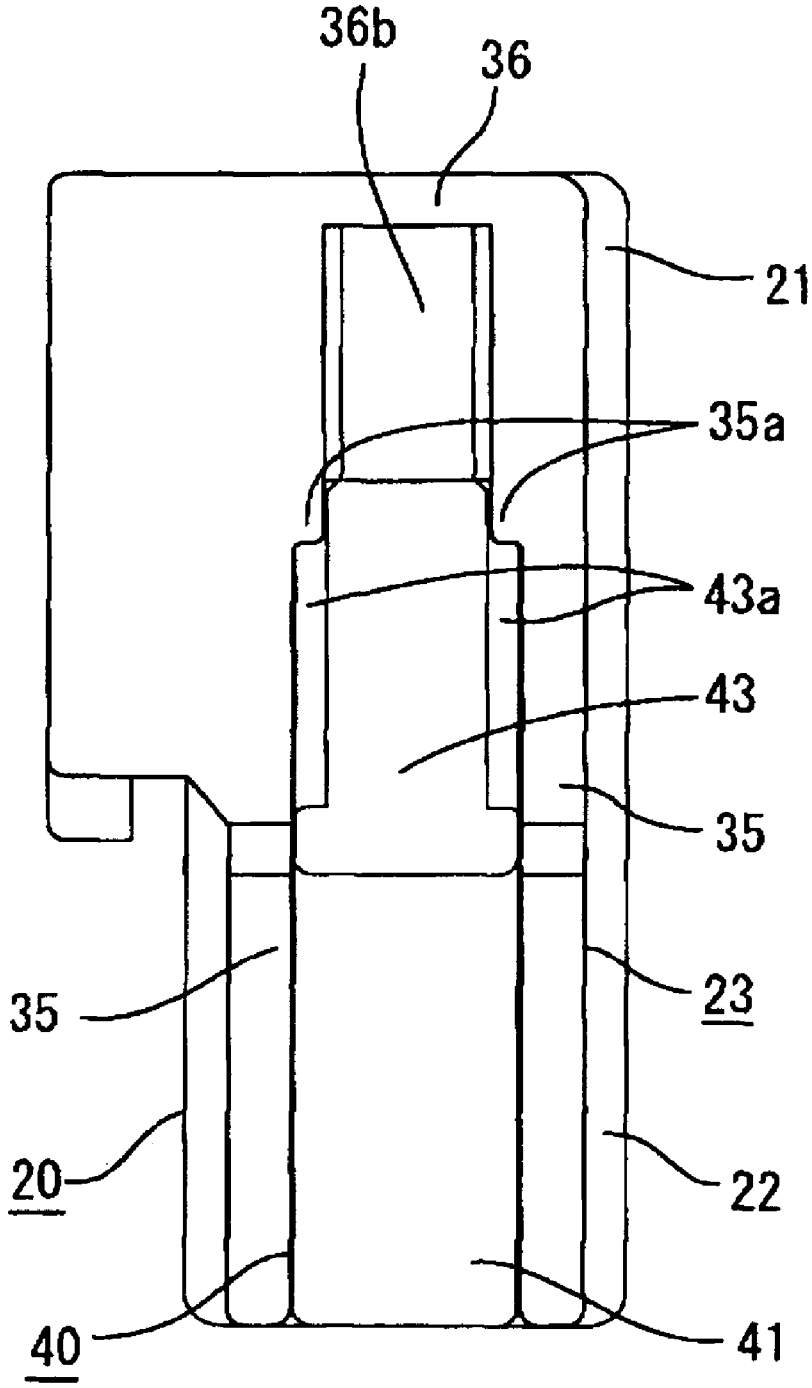
FIG. 10 is a plan view of the male housing having the slider mounted at the initial position.

Pushable arms 45 of the slider 40 can enter spaces left at the opposite sides of the lock arm 31 (see FIG. 9). Two disengagement guides 33 are provided on the upper edge of the terminal accommodating portion 21 at the opposite sides of the lock arm 31 for engaging the pushable arms 45 (see FIG. 13(A)). Each disengagement guide 33 is sloped up and out towards the back, and can guide the corresponding pushable arm 45 so that the pushable arm 45 is deformed resiliently as the slider 40 is moved back (see FIG. 17(A)). Further, an escaping recess 34 is formed in the inner bottom surface of the receptacle 22 for receiving the leading ends of the resilient contacts 27*a* when the resilient contacts 27*a* are deformed resiliently.

Figure 4:
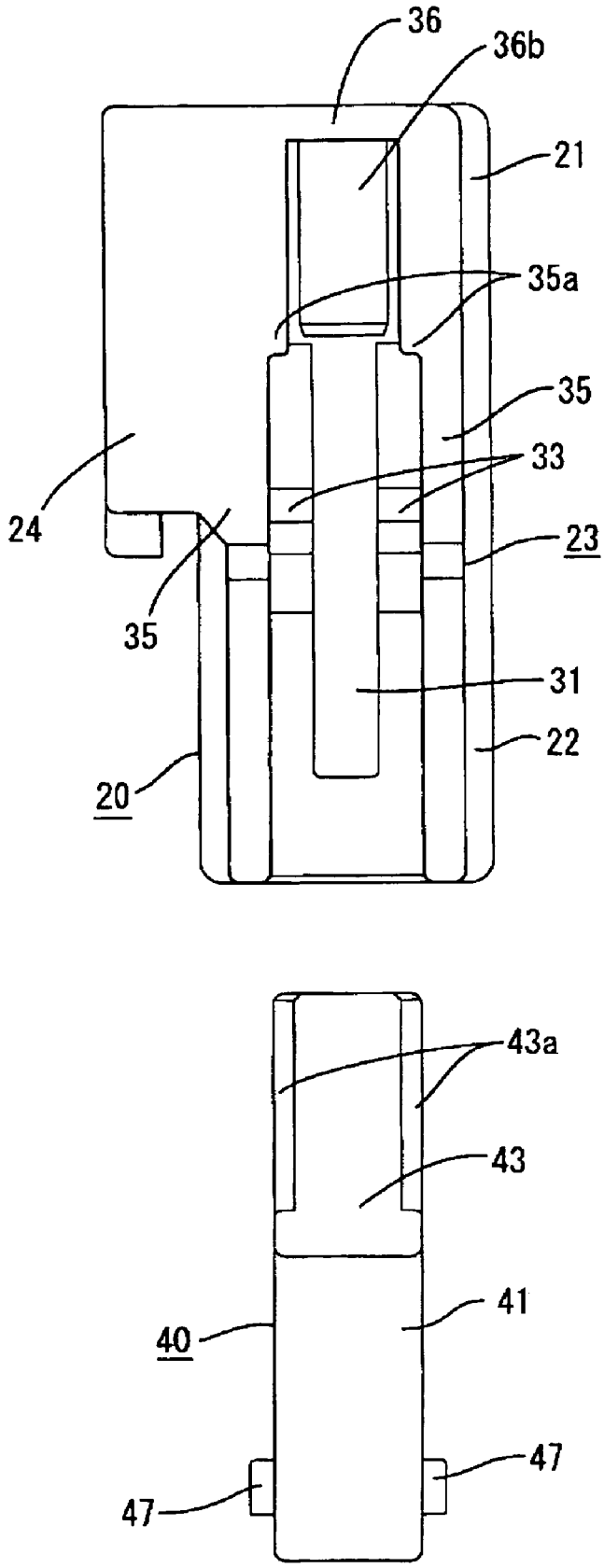
FIG. 4 is a plan view of the male housing and the slider.
Figure 5:
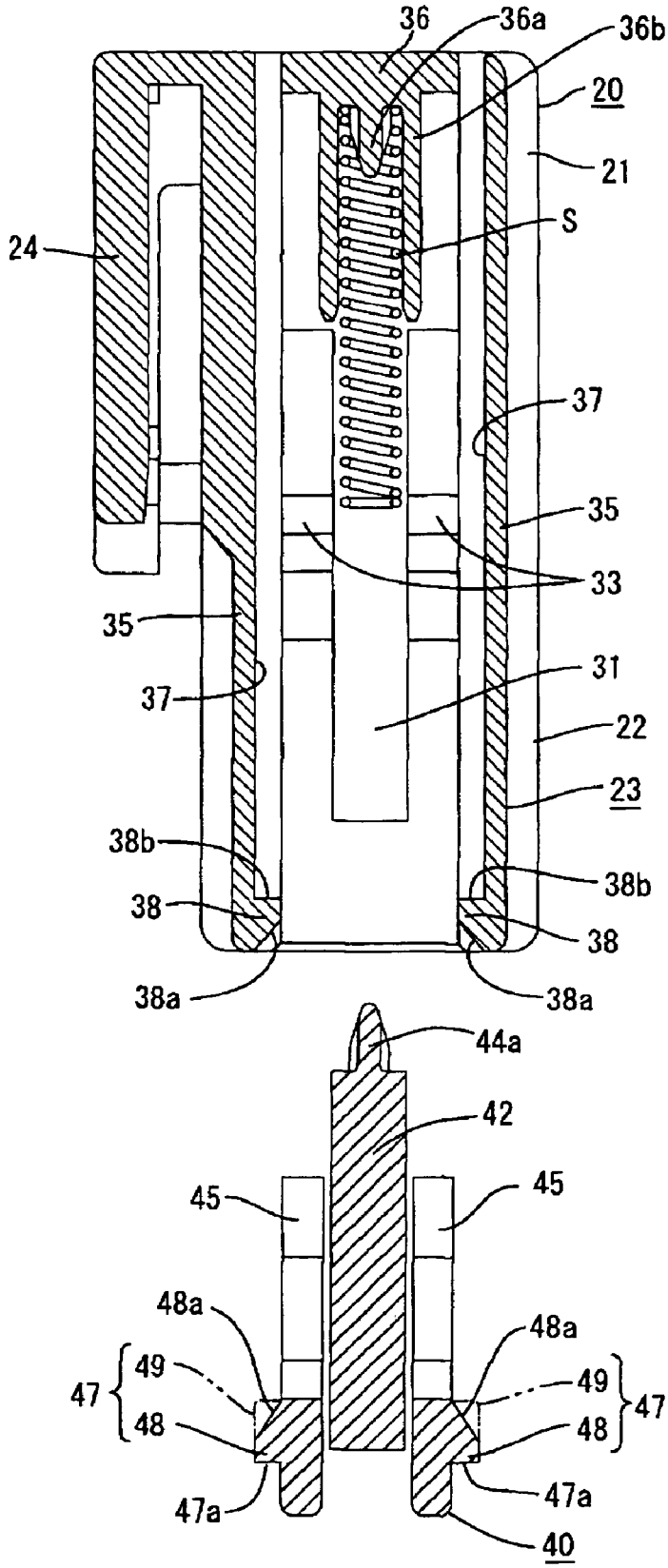
FIG. 5 is a section along 5—5 of FIG. 3.

The partial connection preventing unit assembly 23 has two sidewalls 35 that project up from the upper surfaces of the terminal accommodating portion 21 and the receptacle 22 and extend along forward and backward directions. A rear wall 36 couples the rear ends of the opposite side walls 35. The compression coil spring S and the slider 40 are assembled from the front into a space at least partly surrounded by the sidewalls 35 and the rear wall 36. As shown in FIGS. 5 and 7, the rear wall 36 receives the rear end of the compression coil spring S. A spring holding portion 36*a* is inserted into a rear end of the compression coil spring S. Additionally, a substantially cylindrical spring protection wall 36*b* projects from the front surface of the rear wall 36 and surrounds the outer surface of a rear half of the compression coil spring S, as shown in FIG. 3. Pressing portions 35*a* bulge in from the upper rear ends of the opposite side walls 35, as shown in FIGS. 3 and 4. The pressing portions 35*a* are longer than the spring protection wall 36*b* and capable of pressing or engaging the upper surface of the slider 40.

As shown in FIGS. 3, 5 and 7, two escaping grooves 37 are formed in the inwardly facing surfaces of the sidewalls 35 for receiving locking projections 47 of the slider 40. Receiving portions 38 project near the front ends of the escaping grooves 37 for engaging the locking projections 47. The height of the receiving portions 38 is less than (preferably about ⅔ of) the height of the escaping grooves 37, and the bottom ends thereof are coupled to the bottom edges of the escaping grooves 37. Accordingly, clearances are defined between upper edges 37*a* of the escaping grooves 37 and the upper surfaces of the receiving portions 38. As shown in FIG. 5, less than about half, preferably about ⅓, of each receiving portion 38 at its rear side is substantially a rectangular parallelepiped, whereas more than about half, preferably about ⅔, thereof at its front side has a substantially triangular horizontal cross section tapered out towards the front. Accordingly, a slanted guiding surface 38*a* is defined at the front of each receiving portion 38 for guiding the locking projection 47 into the escaping groove 37. The spacing between the guiding surfaces 38*a* of the receiving portions 38 is gradually widened from the rear end towards the front end. A rear surface 38*b* of each receiving portion 38 is substantially straight along vertical and widthwise directions, as shown in FIG. 7, and serves as a locking surface for engaging the locking projection 47. The rear halves of the opposite side walls 35 are slightly higher than the front halves and are substantially the same height as the slider 40.

The slider 40 is made e.g. of a synthetic resin and includes a slider main body 41 in the form of a substantially flat plate extending substantially along forward and backward directions, as shown in FIGS. 3 and 4. The slider 40 is movable substantially along forward and backward directions while being mounted in the assembling portion 23 and is held substantially in sliding contact with the inner surfaces of the side walls 35 and the outer surfaces of the terminal accommodating portion 21, the receptacle 22 and lock arm 31.

Figure 6:
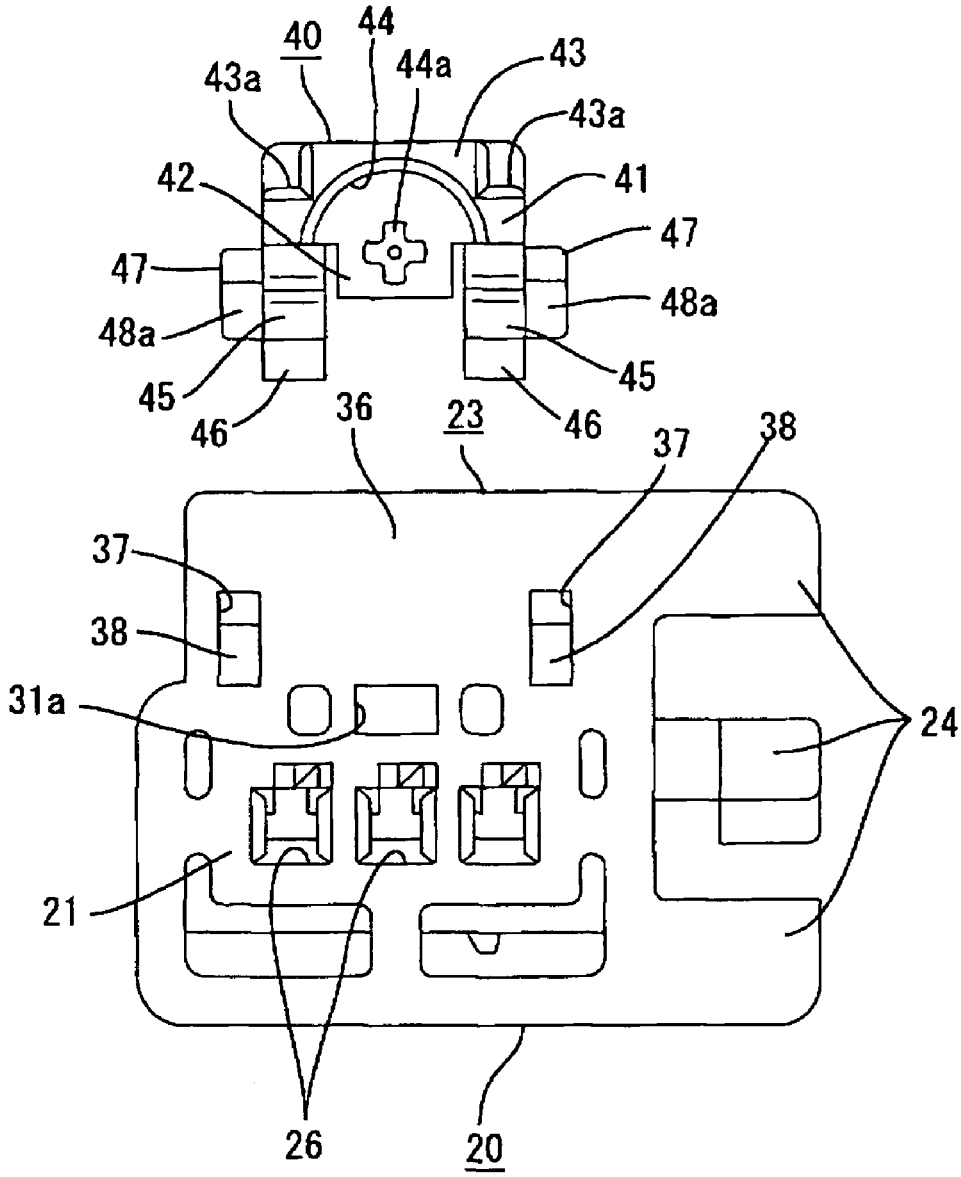
FIG. 6 is a rear view of the male housing and the slider.
Figure 13A:
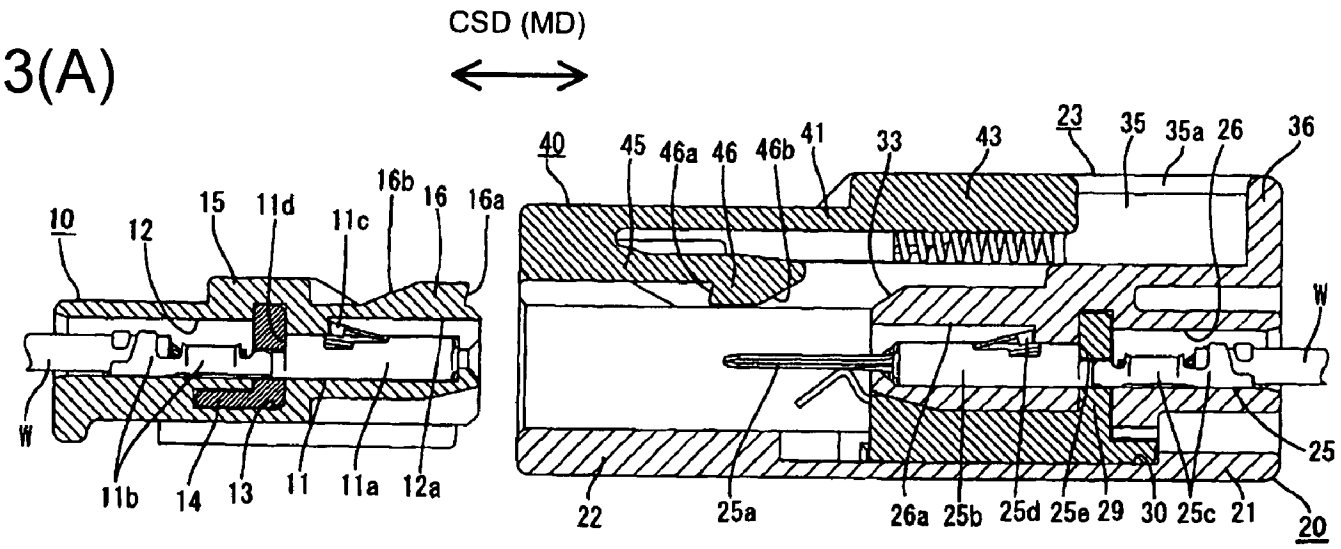
FIGS. 13(A) and 13(B) are a section along 13(A)—13(A) of FIG. 9 and a section along 13(B)—13(B) of FIG. 9 showing a state before the two housings are connected.
Figure 13B:
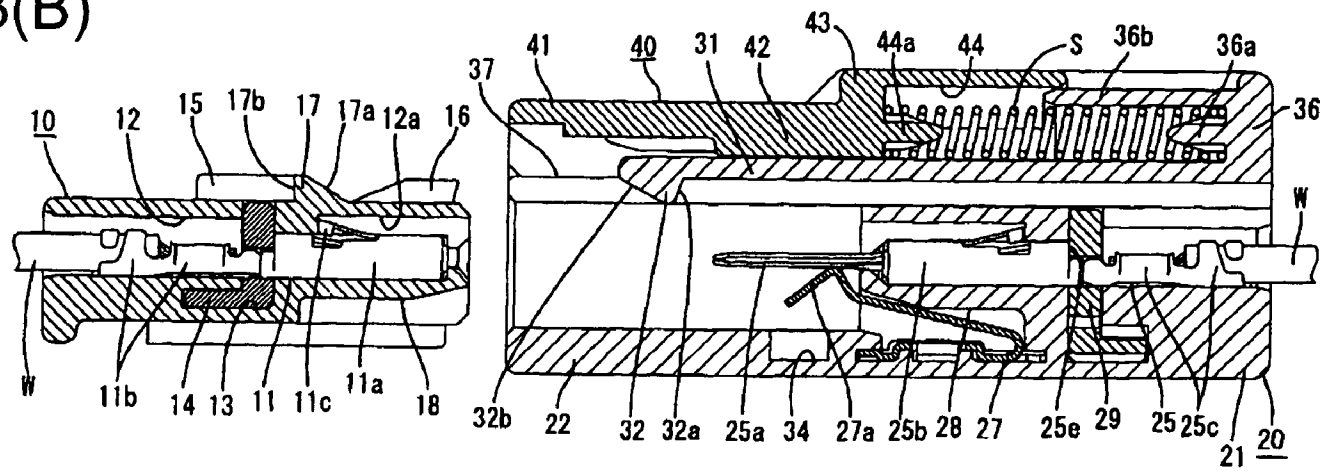

The slider main body 41 is slightly narrower than or as wide as the spacing between the inner surfaces of the sidewalls 35. A bulge 42 projects down and in to form a substantially step shape in an intermediate widthwise portion at the front side of the lower surface of the slider main portion 41 to define a permitting space that permits resilient deformation of the lock arm 31 (see FIG. 16(B)). The lower surface of the bulge 42 can contact the upper surfaces of the lock arm 31 and the terminal accommodating portion 21 in the assembled state of the slider 40. On the other hand, an operating portion 43 is formed at a rear portion of the upper surface of the slider main body 41 and enables the slider 40 to be pulled from outside. The operating portion 43 projects up to substantially the same height as the upper ends of the sidewalls 35 in the assembled state of the slider 40, as shown in FIG. 7. As shown in FIGS. 4 and 7, escaping portions 43*a* are formed at the opposite side edges of the operating portion 43, and the pressing portions 35*a* of the male housing 20 can enter the escaping portions 43*a*. A protection-wall escaping portion 44 extends into the rear of the slider main body 41 and continues forward towards the bulge 42 and the operating portion 43, as shown in FIGS. 6 and 13(B). The protection-wall escaping portion 44 has a depth for receiving the spring protection wall 36*b* of the male housing 20. A spring holder 44*a* projects from the back surface of the protection-wall escaping portion 44 and can receive and support a front end portion of the compression coil spring S.

As shown in FIGS. 3 and 7, two pushable arms 45 project from the opposite sides of the bulge 42 at the front end of the lower surface of the slider main body 41. The pushable arms 45 cantilever backward, and are vertically resiliently deformable about their front ends. The spacing between the inner surfaces of the pushable arms 45 is substantially equal to or larger than the width of the lock arm 31. Substantially hook-shaped pushable portions 46 project down from the free rear ends of the pushable arms 45. As shown in FIG. 13(A), each pushable portion 46 has a front surface 46*a* that is overhanging or undercut substantially in conformity with the front surface 16*a* of the pushing portion 16. Thus, the pushing portion 16 of the female housing 10 can push the pushable portion 46 securely. Each pushable portion 46 also has a rear surface 46*b* that is slanted substantially in conformity with the disengagement guide 33. Thus, the rear surface 46*b* of the pushable portions 46 move smoothly onto the disengagement guides 33 to deform the pushable arms 45 resiliently as the slider 40 is moved backward.

The slider 40 is assembled to an initial position in the partial connection preventing unit assembly 23 so that the front end of the slider 40 substantially aligns with the front end of the male housing 20, as shown in FIGS. 9 to 11 and 13. Additionally, the bulge 42 substantially closes the deformation space above the lock arm 31 and prevents resilient deformation of the lock arm 31. At this initial position, front-ends of the pressing portions 35*a* enter both escaping portions 43*a* of the slider 40 to press the rear end of the slider 40 (see FIG. 10). Further, a front-end of the protection wall 36*b* enters the protection-wall escaping portion 44 so that the compression coil spring S is substantially covered over the entire length by the spring protection wall 36*b* and the peripheral edge of the protection-wall escaping portion 44 (see FIGS. 11 and 13(B)). Further, the compression coil spring S is compressed slightly at this initial position to suppress a backward shaking movement of the slider 40 from the initial position.

Figure 11:
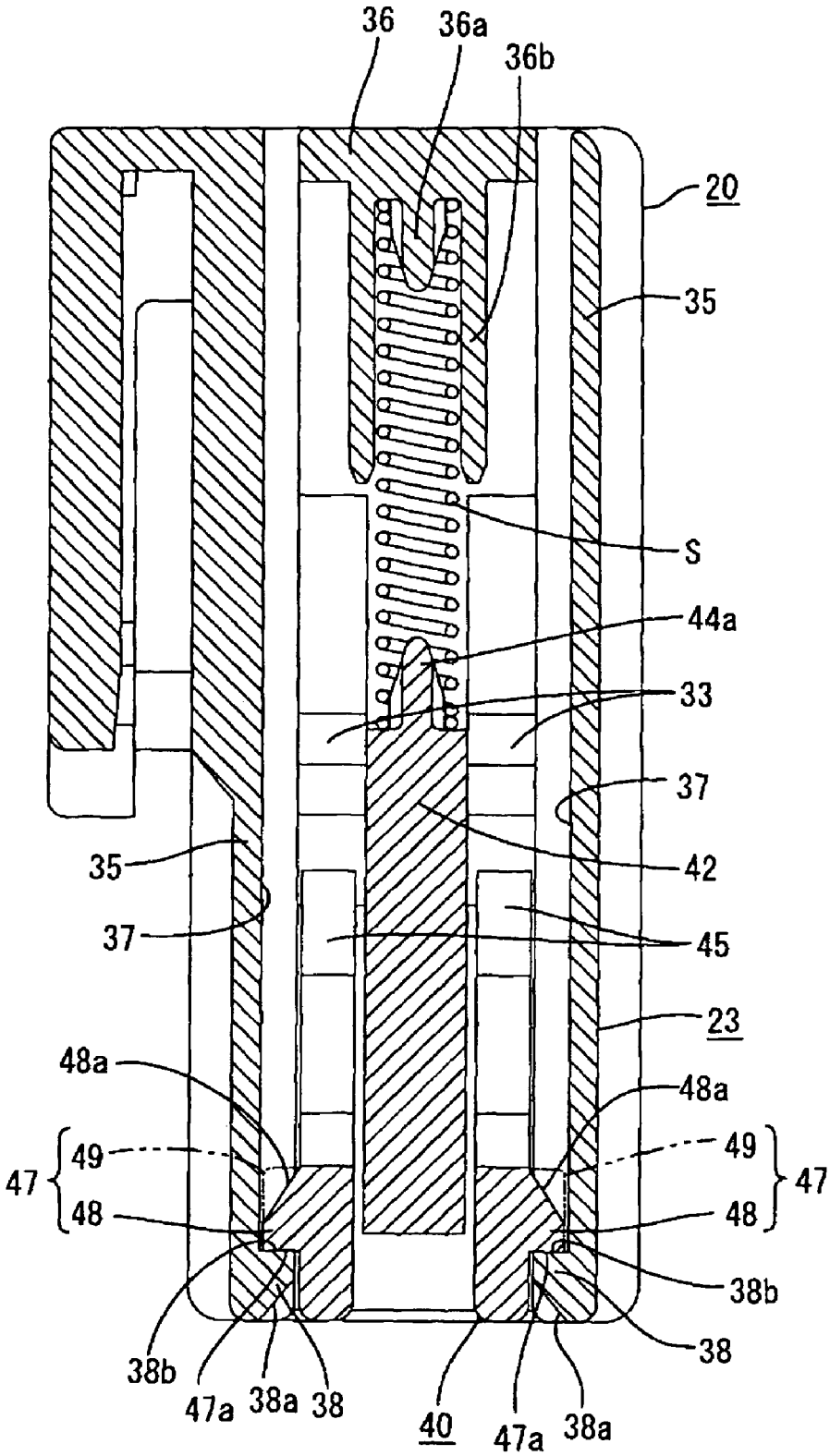
FIG. 11 is a section along 11—11 of FIG. 9.

Locking projections 47 project sideways from the outer side surfaces of both pushable arms 45 of the slider 40 and engage the receiving portions 38 of the male housing 20, as shown in FIG. 11, when the slider 40 is assembled at the initial position. Thus, the slider 40 can be held so as not to come out forward from the initial position. A front surface 47*a* of each locking projection 47 is vertically straight over its entire height and engageable with the rear surface 38*b* of the corresponding receiving portion 38.

As shown in FIGS. 3 and 7 to 9, each locking projection 47 has a height that is slightly smaller than the height of the escaping groove 37 of the female housing 10. Additionally, an assembly guide 48 is defined on more than about half and preferably about the lower ⅔ of the locking projection 47. The assembly guide 48 has a height substantially equal to the height of the receiving portion 38. A restriction 49 is defined on less than about half an preferably about the upper ⅓ of the assembly guide 48 and is engageable with the upper edge 37*a* of the escaping groove 37. Thus, the restrictions 49 are at a side of the locking projections 47 substantially opposed to the upper surface of the male housing 20 on which the slider 40 is to be mounted. Further, a lateral projecting distance of the locking projections 47 is to be substantially equal to or smaller than the depth of the escaping grooves 37. The entire length of the locking projections 47 is set so that an operation force required to assemble the slider 40 takes a specified reference value or smaller.

Less than about half and preferably about the front ⅓ of each assembling guide 48 is a rectangular parallelepiped, whereas more than about half and preferably about the rear ⅔ thereof has a substantially triangular horizontal cross section to project out less gradually towards the rear end. Accordingly, the assembling guide 48 has a slanted rear guiding surface 48*a*. The guiding surfaces 48*a* of the assembling guides 48 slide in contact with the guiding surfaces 38*a* of the receiving portions 38 when the slider 40 is assembled, and guide the locking projections 47 over the receiving portions 38. In this way, an operation force required to assemble the slider 40 can be reduced. Further, the spacing between the two guiding surfaces 48*a* is gradually narrowed from the front end towards the rear end.

Figure 12:
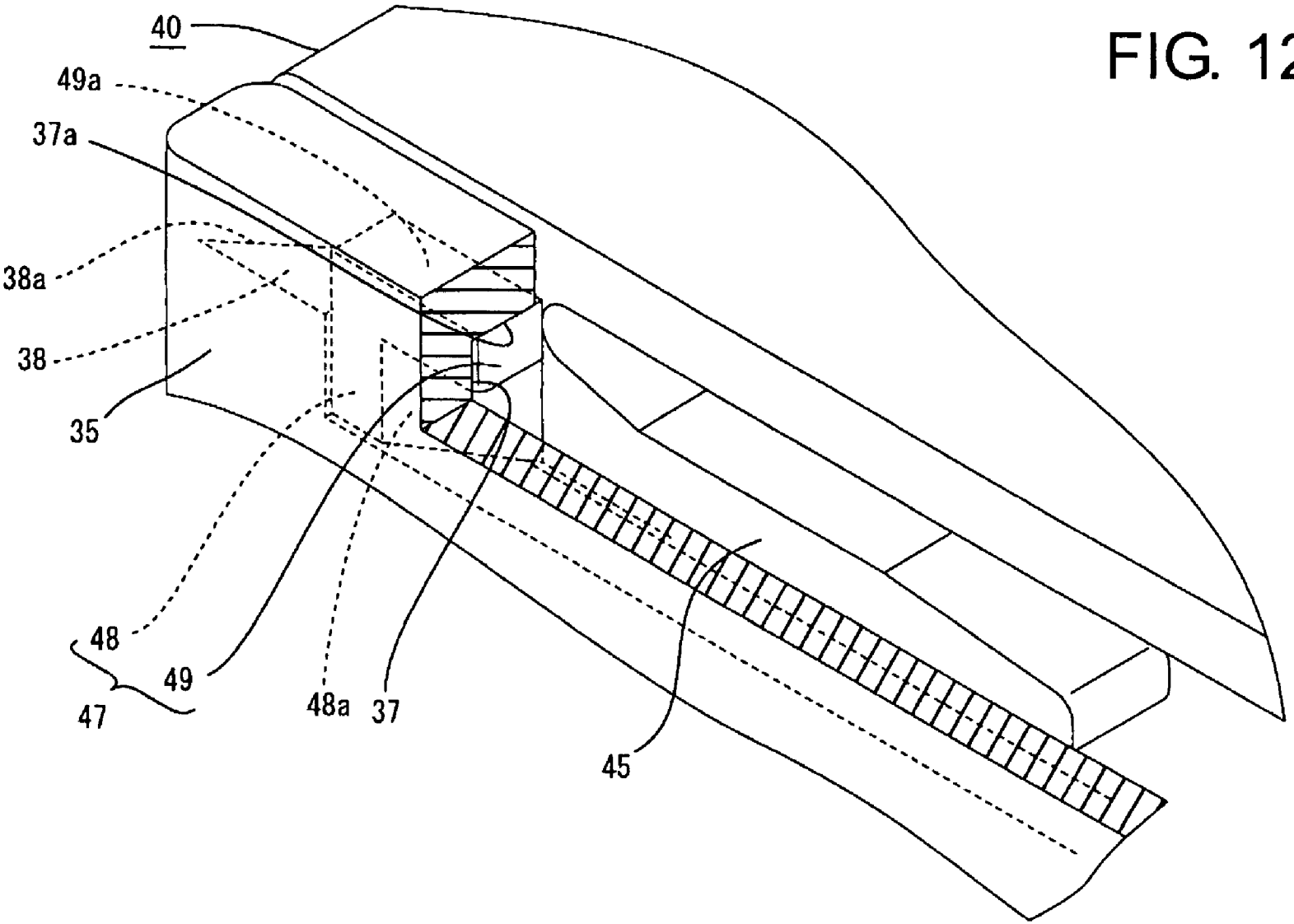
FIG. 12 is an enlarged partial perspective view partly in section showing a state where the slider is mounted at the initial position in the male housing.

Each restriction 49 is substantially a rectangular parallelepiped, and bulges out more outward than the guiding surface 48*a*. As shown in FIG. 12, an upper surface 49*a* of each restriction 49 is engageable with the upper edge 37*a* of the corresponding escaping groove 37 when the slider 40 is assembled to restrict an upward displacement of the slider 40. The upper surface 49*a* of each restriction 49 is substantially rectangular in plan view and has an area larger than the lower surface of the assembling guide 48 by as much as the restriction 49 bulges out from the guiding surface 48*a*. The rear surface of each restriction 49 is vertically straight, but can pass a clearance between the receiving portion 38 and the upper edge 37*a* of the escaping groove 37 upon assembling the slider 40. Thus, the operation force required to assemble the slider 40 is not increased.

The male connector is assembled by mounting the male terminal fittings 25, the shorting terminal 27 and the retainer 29 into the male housing 20. Additionally, the compression coil spring S and the slider 40 are assembled successively into the partial connection preventing unit assembly 23 from the front. The compression coil spring S is inserted into the spring protection wall 36*b*, so that the spring holding portion 32*a* enters the rear end of the compression coil spring S, as shown in FIGS. 5 and 7.

The slider 40 is assembled by inserting the pushable arms 45 into the spaces at the opposite sides of the lock arm 31. Thus, the bulge 42 slides in contact with the upper surface of the lock arm 31. The guiding surfaces 48*a* of the locking projections 47 contact the guiding surfaces 38*a* of the receiving portions 38 when the slider 40 reaches a specified position. The slider 40 then is moved back in the moving direction MD. As a result, the guiding surfaces 38*a*, 48*a* are held substantially in sliding contact with each other. The locking projections 47 move over the receiving portions 38 and enter the escaping grooves 37 when the slider 40 reaches the initial position. The operation force at this time is smaller as compared to a case where there is no guiding surface. At this time, as shown in FIGS. 11 and 12, the front surfaces 47*a* of the locking projections 47 contact the rear surfaces 38*b* of the receiving portions 38 to hold the slider 40 to prevent the slider 40 from moving further forward from the initial position. As an alternate, the compression coil spring S could be assembled with the slider 40, and they may be assembled simultaneously into the assembling portion 23. In the meantime, the female connector is also assembled.

Figure 14A:
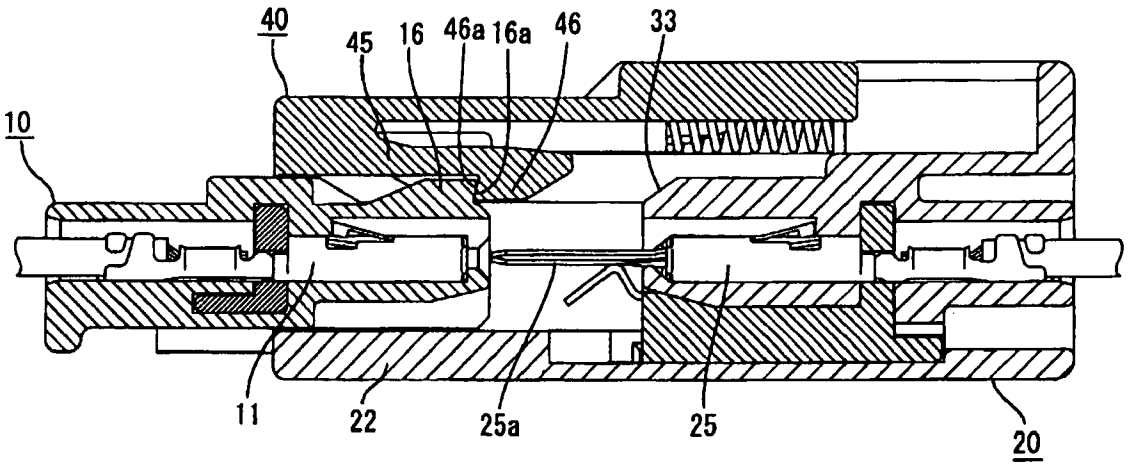
FIG. 14(A) is a section similar to FIG. 13(A) but showing the pushing portions in contact with pushable portions and FIG. 14(B) is a section similar to FIGS. 13(B) but showing an intermediate state of connection of the housings.
Figure 14B:
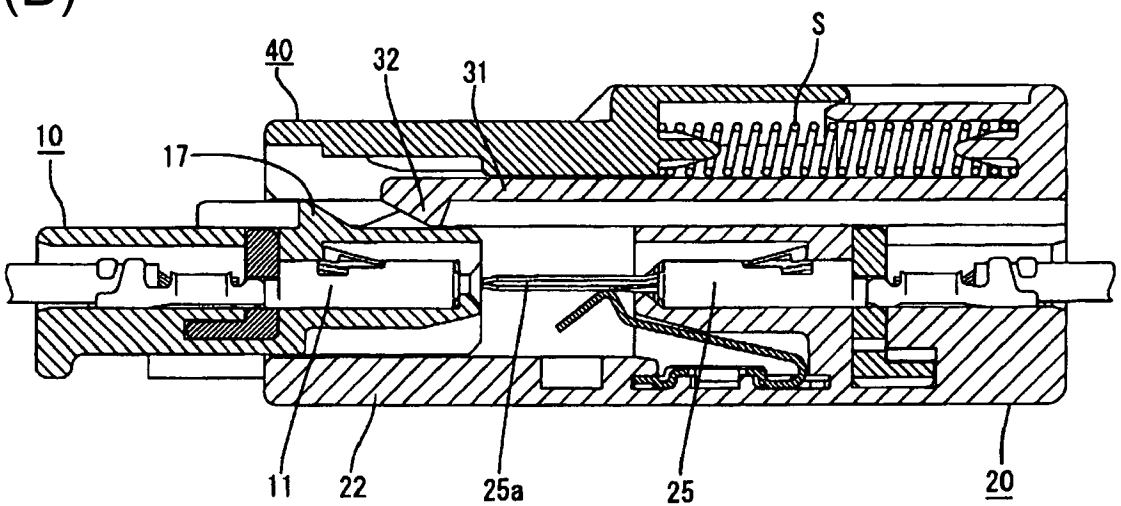
Figure 15A:
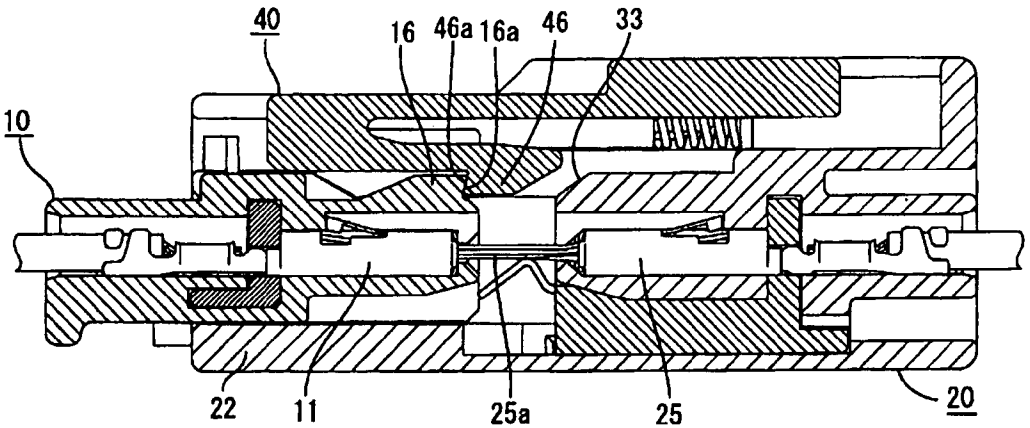
FIG. 15(A) is a section similar to FIG. 13(A) but showing the pushable portions pushed in by the pushing portions and FIG. 15(B) is a section similar to FIGS. 13(B) but showing a lock arm is in contact with a lock.

The female housing 10 is fit to a specified depth in the receptacle 22 of the male housing 20 from a state shown in FIG. 13. Thus, the front surfaces 16*a* of the pushing portions 16 contact the front surfaces 46*a* of the pushable portions 46 as shown in FIG. 14. At this stage, the contact of the terminal fittings 11, 25 has not started. The connection progresses from this state and the pushing portions 16 push the pushable portions 46. As a result, the slider 40 is moved back in the moving direction MD from the initial position and the compression coil spring S is compressed resiliently while accumulating a biasing force, as shown in FIG. 15. In this process, the contact of the terminal fittings 11, 25 is started and the bulge 42 is retracted back from the deformation space for the lock arm 31.

The connecting operation may be interrupted halfway, for example, due to an operator's misunderstanding that the two housings 10, 20 have been properly connected. In this case, the biasing force accumulated in the compression coil spring S is released and the forwardly biased pushable portions 46 of the slider 40 push back the pushing portions 16 to separate the two housings 10, 20. In this way, a situation where the two housings 10, 20 are left partly connected can be avoided.

Figure 15B:
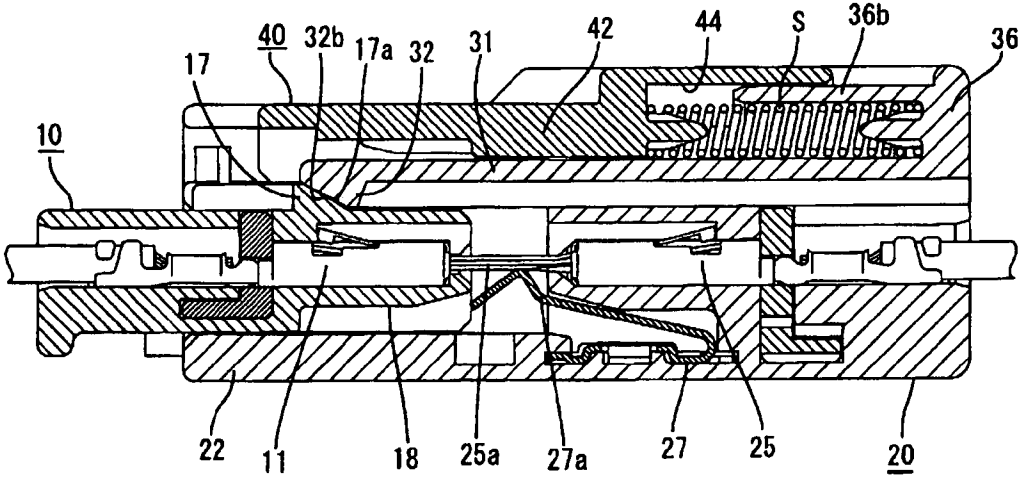
Figure 16A:
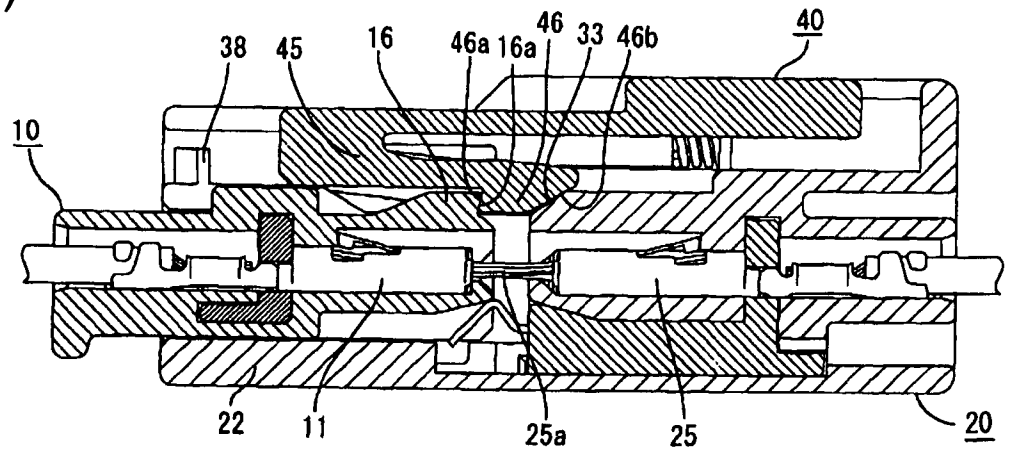
FIG. 16(A) is a section similar to FIG. 13(A) but showing the pushable portions in contact with disengagement guides and FIG. 16(B) is a section similar to FIGS. 13(B) but showing the lock arm resiliently deformed.
Figure 16B:
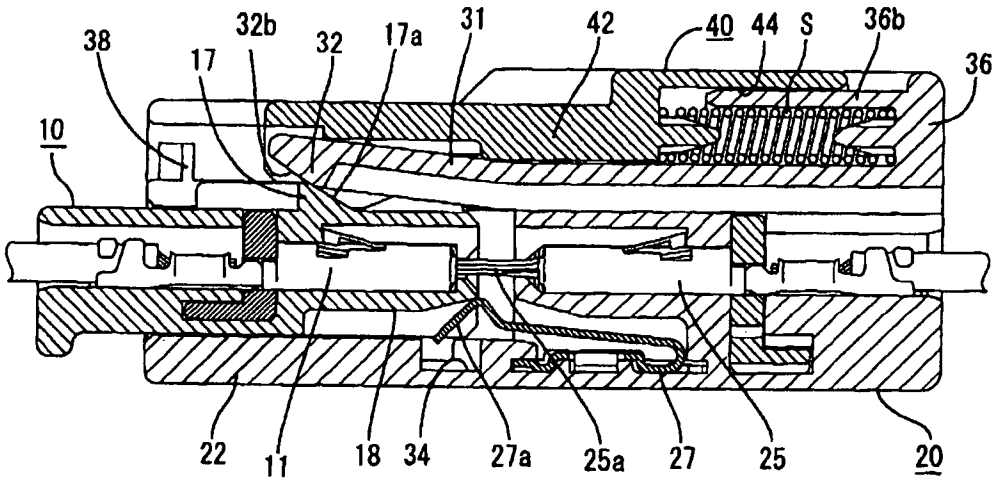
Figure 17A:
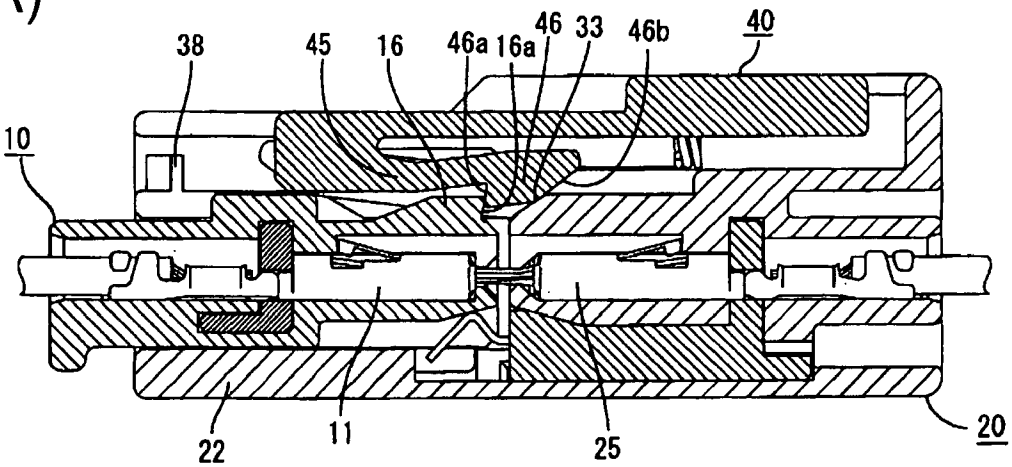
FIG. 17(A) is a section similar to FIG. 13(A) but showing the pushable arms resiliently deformed and FIG. 17(B) is a section similar to FIGS. 13(B) but showing a state where the lock arm is further resiliently deformed.
Figure 17B:
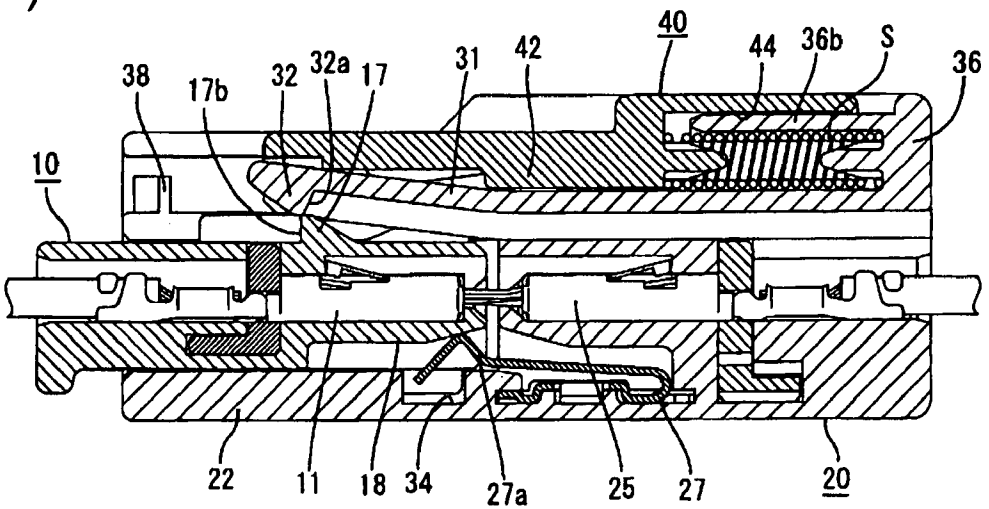

The connection may progress further after the front surface 32*b* of the locking claw 32 of the lock arm 31 contacts the front surface 17*a* of the lock 17 (see FIG. 15(B)). Thus, the lock arm 31 deforms resiliently up and moves onto the lock 17, as shown in FIG. 16. In this process, the slanted rear surfaces 46*b* of the pushable portions 46 are held in sliding contact with the disengagement guides 33. As a result, the pushable portions 46 move onto the disengagement guides 33 and the pushable arms 45 deform resiliently up in a pushed-state canceling direction, as shown in FIG. 17. The pushable portions 46 are displaced up and out as the connection progresses. Thus, areas of contact of the pushable portions 46 with the pushing portions 16 gradually decrease. Further in this process, the resilient contacts 27*a* of the shorting terminal 27 enter the disengaging groove 18 of the female housing 10 and are pushed down by the peripheral edge of the disengaging groove 18. Therefore, the resilient contacts 27*a* gradually separated from the tabs 25*a* and cancel the shorted state of the two male terminal fittings 25.

Figure 18A:
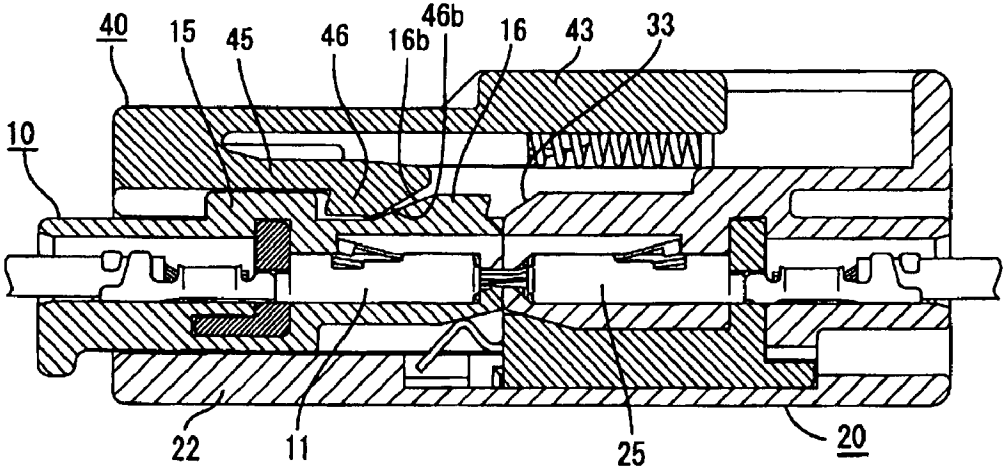
FIG. 18(A) is a section similar to FIG. 13(A) but showing a state where the two housings are connected properly and the slider is at the initial position.
Figure 18B:
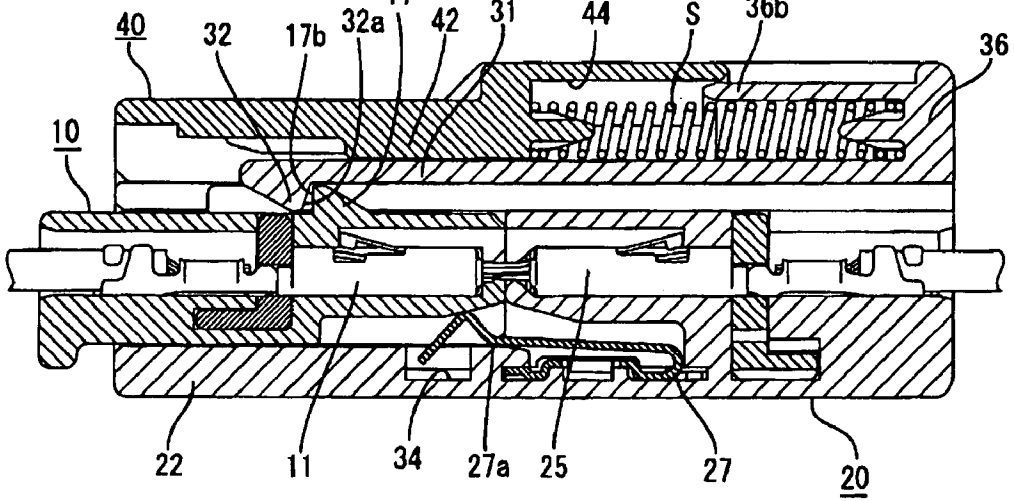
FIG. 18(B) is a section similar to FIG. 13(B) but showing a state where the two housings are properly connected and the lock arm is engaged with the lock portion.
Figure 19A:
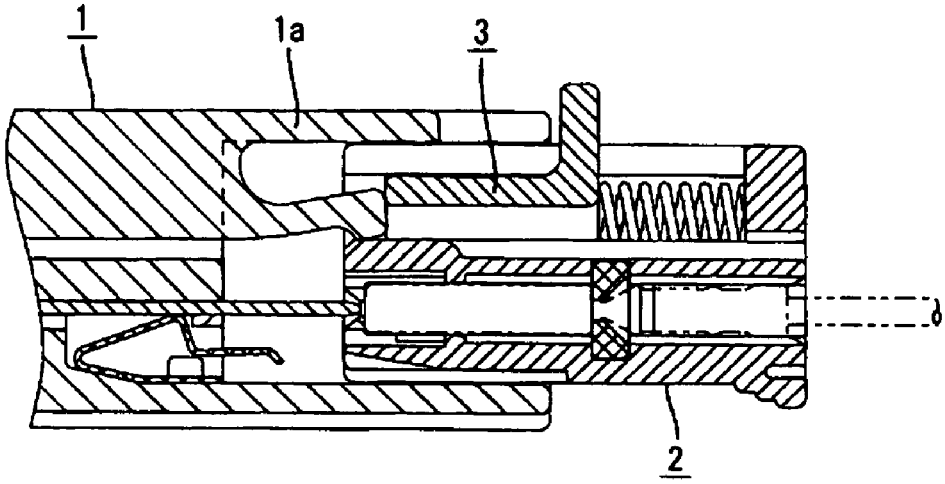
FIGS. 19(A) and 19(B) are side views in section of a prior art connector.
Figure 19B:
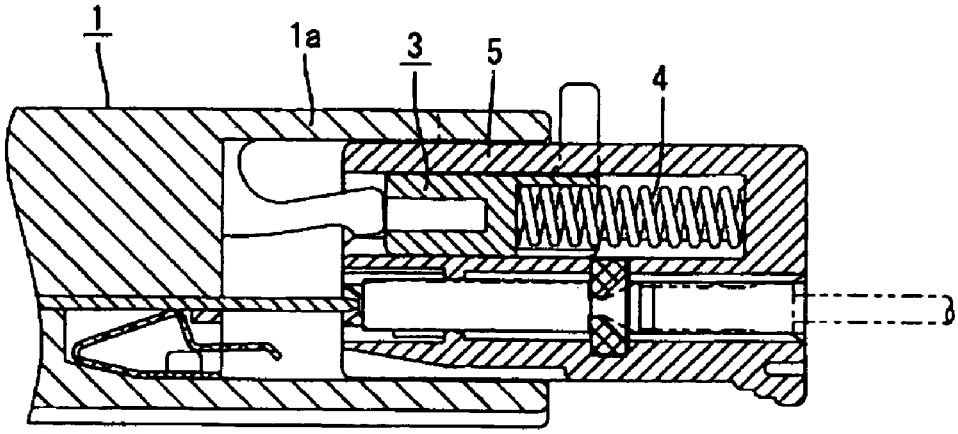
Figure 20:
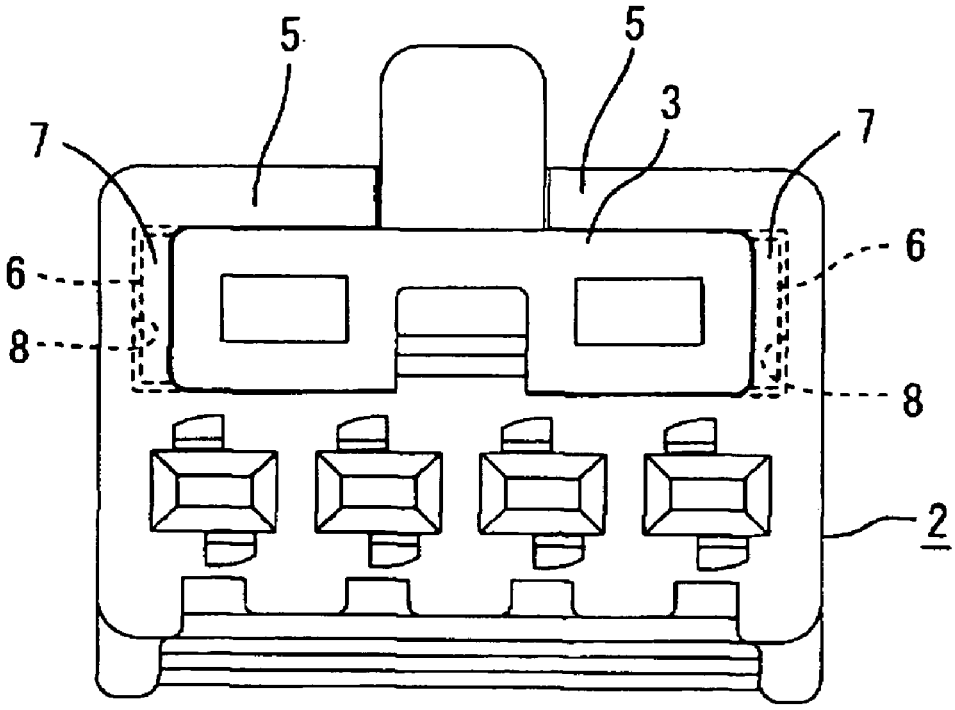
FIG. 20 PRIOR ART
FIG. 20 is a front view of the prior art connector.

When the two housings 10, 20 are connected to a proper depth, the locking claw 32 of the lock arm 31 moves over the lock 17 and the lock arm 31 is restored resiliently and the rear surface 32*a* of the locking claw 32 engages the rear surface 17*b* of the lock 17, as shown in FIG. 18(B). At this time, the lock arm 31 is retracted completely from the space before the bulge 42. On the other hand, as the two housings 10, 20 are properly connected, the slider 40 reaches a position where the pushable portions 46 disengage from the pushing portions 16 and are freed completely from the pushed state. Thus, the slider 40 can move along the moving direction MD. Accordingly, the biasing force of the compression coil spring S is released to move the slider 40 forward. When the slider 40 reaches the initial position, the locking projections 47 contact the receiving portions 38, thereby preventing the slider 40 from moving any further forward. In this properly connected state, the bulge 42 is above the lock arm 31, thereby deformation of the lock arm 31. Further, the pushable portions 46 escape into the clearances between the pushing portions 16 and the reinforcing portions 15 and return to their natural states.

The two housings 10, 20 may need to be separated for maintenance or other reason. In this a case, the operating portion 43 of the slider 40 is pulled back to move the slider 40 back from the initial position and to compress the coil spring S. In this process, the rear surfaces 46*b* of the pushable portions 46 slide in contact with the rear surfaces 16*b* of the pushing portions 16. Thus, the pushable portions 46 move onto the pushing portions 16 and the pushable arms 45 deform resiliently up. The slider 40 reaches a specified position where the bulge 42 is retracted from the deformation space for the lock arm 31. Thus, an operation force given in this state guides the locking claw 32 onto the lock 17 due to the inclination of the rear surface 32*a* thereof. Accordingly, the lock arm 31 is deformed resiliently and the locked state of the two housings 10 20 is canceled (see FIG. 17(B)). The two housings 10, 20 can be separated by further pulling the slider 40 in this state.

As described above, the slider 40 is moved forward and backward substantially along the moving direction MD upon connecting and separating the two housings 10, 20 along the connecting and separating directions CSD (the moving direction MD is substantially parallel to the connecting and separating directions CSD). In this moving process, the entire slider 40 may be displaced upward to hinder its sliding movement. However, the upper surfaces 49*a* of the restrictions 49 of the locking projections 47 engage the upper edges 37*a* of the escaping grooves 37 at the front side of the slider 40, whereas the pressing portions 35*a* are engageable with the escaping portions 43*a* at the rear side of the slider 40. Thus, the upward displacement (i.e. the displacement in a direction intersecting the moving direction MD) of the slider 40 is restricted constantly. This smoothes movement of the slider 40, thereby improving the connecting/separating operability.

As described above, according to this embodiment, the locking projections 47 are provided with the restrictions 49 that bulge out more than the guiding surfaces 48*a*. Upper surfaces 49*a* of the restrictions 49 engage the upper edges 37*a* of the escaping grooves 37 to restrict a displacement of the slider 40 along the direction intersecting the moving direction MD of the slider 40. Thus, areas of engagement of the restrictions 49 with the escaping grooves 37 can be increased by as much as the restrictions 49 bulge out from the guiding surfaces 48*a*. As a result, the displacement of the slider 40 is restricted. A satisfactory assembling operability can be ensured for the slider 40 by providing the guiding surfaces 48*a* as before.

The slider 40 is mounted on the upper surface of the male housing 20 and hence is prone to displace upward. However, displacement of the slider 40 is restricted by the restricting portions 49 at the side of the locking projections 47 substantially opposite the upper surface of the male housing 20.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The shape of the locking projections can be arbitrarily changed. In short, it is sufficient that the restricting portions bulge out more than the guiding surfaces. For example, a pair of restricting portions may be provided on the upper and lower sides of each assembling guiding portion and may be brought into engagement with the upper edge of the corresponding escaping groove. The shape of the receiving portions can also be changed. For example, the guiding surfaces thereof may be omitted according to the present invention.

The positions of the receiving portions are not restricted to the front end positions of the escaping grooves, and may be intermediate positions of the escaping grooves.

The guiding surfaces are not restricted to slanted surfaces, and may be curved surfaces, such as arcuate or rounded surfaces.

The slider may be provided with the escaping grooves and the receiving portions and the male housing may be provided with the locking projections. An embodiment in which the slider and the compression coil spring are assembled into the female housing and the pushing portions are provided at the male housing is also embraced by the invention. Further, the slider may be assembled into the housing from behind.

A leaf spring or a tension coil spring or a resilient rod can also be used as a biasing member.

In the foregoing embodiment, the front end of the compression coil spring is supported by the slider, the rear end is supported by the male housing and the slider is pushed in by the female housing. However, the invention is also applicable to other connectors provided that a slider supports one end of a biasing means and the slider is moved when two housings are connected to thereby release a biasing force accumulated in the biasing means. For example, the invention is applicable to a connector where a rear end of a compression coil spring is supported by a slider and a front end is pushed in by a pushing portion of a female housing (for example, see Japanese Unexamined Patent Publication No. 2000-331745).

What is claimed is:

1. A connector, comprising:

a housing having opposite front and rear ends, the front end being configured for receiving a mating housing of a mating connector;

a slider assembled in the front end of the housing and movable along connecting and separating directions of the two housings; and a biasing member in the housing and capable of accumulating a biasing force to separate the two housings by being pushed by the mating housing during connection of the housings, wherein:

the housing includes at least one escaping groove extending rearwardly from the front end of the housing and being defined by at least first and second intersecting surfaces extending substantially parallel to the connecting and separating directions, and at least one receiving portion projecting from the first surface of the escaping groove and being spaced from the second surface thereof;

at least one locking projection formed on the slider and having a guiding surface for guiding a movement of the locking projection over the receiving portion when the slider is assembled and a restriction configured for entering the escaping groove between the receiving portion and the second surface of the escaping groove and sliding against the second surface of the escaping groove for restricting displacement of the slider along a direction intersecting a moving direction of the slider; and the restriction bulges out more than the guiding surface.

2. The connector of claim 1, wherein the slider is mounted on one side surface of the housing, and the restriction is provided at a side of the locking projection substantially opposite from the mounting surface of the housing.

3. A connector assembly comprising the connector of claim 1 and a mating connector connectable with each other.

4. The connector of claim 1, wherein the at least one escaping groove includes first and second escaping grooves substantially opposed to each other, and the at least one receiving portion comprises first and second receiving portions substantially opposed to one another, the slider having first and second locking projections, each of said locking projections having a restriction configured for entering their respective escaping groove between the second surface of the escaping groove and the corresponding receiving portion, each said locking projection further having a guiding surface disposed and configured for guiding movements of the corresponding locking portion over one of the receiving portions.

5. The connector of claim 1, wherein the slider supports one end of the biasing member and moves as the housings connect properly, thereby releasing the biasing force of the biasing member.

6. The connector of claim 5, wherein the slider has interlocking means for preventing disengagement of the properly connected housings.

7. The connector of claim 1, wherein the slider comprises at least one pushable portion that can be pushed by at least one pushing portion on the mating housing as housings are connected.

8. The connector of claim 7, wherein the pushable portions are formed with an overhanging surface and the pushing portions have a substantially correspondingly inclined surface.

9. The connector of claim 7, wherein the housing and the slider comprise at least one disengagement guide for guiding a disengagement of the pushable portion and the pushing portion when the two housings are substantially properly connected.

10. A connector, comprising:

a housing having opposite front and rear ends, the front end of the housing being open for receiving a mating housing along connecting and separating directing directions, first and second opposed grooves extending in the housing substantially along the connecting and separating directions, the first groove having a first outer surfaces and a first guide surfaces, the second groove having a second outer surface opposed to the first outer surface and a second guide surface substantially coplanar with the first guide surface, first and second receiving portions being formed respectively in the first and second grooves and projecting towards one another from the respective first and second outer surfaces and spaced from the respective first and second guide surfaces;

at least one spring disposed in the housing for exerting a forward biasing force; and a slider mounted in the housing for sliding movement substantially along the connecting and separating directions, the slider being biased forwardly by the spring, the slider having first and second locking projections slidably disposed respectively in the first and second grooves, each said locking projection having a guiding surface sloped for guiding a movement of the locking projection over the receiving portion when the slider is assembled to the housing, each said locking projection further having a restriction projecting beyond the guiding surface and configured for sliding movement between the receiving portion and the guide surface of the respective groove when the slider is assembled with the housing.

* * * * *